US006635609B2

(12) United States Patent
Sutton

(10) Patent No.: US 6,635,609 B2
(45) Date of Patent: Oct. 21, 2003

(54) SURFACE MAINTENANCE COMPOSITION

(75) Inventor: David C. Sutton, Racine, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 10/073,815

(22) Filed: Feb. 11, 2002

(65) Prior Publication Data

US 2003/0153478 A1 Aug. 14, 2003

(51) Int. Cl.[7] ..... C11D 1/835

(52) U.S. Cl. ..... 510/240; 510/119; 510/123; 510/124; 510/130; 510/329; 510/330; 510/356; 510/382; 510/384; 510/391; 510/366; 510/421; 510/504

(58) Field of Search ..... 510/119, 123, 510/124, 130, 240, 329, 330, 356, 382, 384, 391, 366, 421, 504

(56) References Cited

U.S. PATENT DOCUMENTS 4,561,993 A * 12/1985 Choy et al. ..... 252/174.25
4,725,319 A 2/1988 Osberghaus ..... 134/4
4,738,876 A 4/1988 George et al. ..... 427/299
5,264,269 A * 11/1993 Kakiuchi et al. ..... 428/156
5,462,697 A 10/1995 Yianakopoulos ..... 252/528
5,490,883 A 2/1996 McLaren et al. ..... 134/3
5,554,320 A 9/1996 Yianakopoulos ..... 252/389.23
5,658,557 A * 8/1997 Bolich, Jr. et al. ..... 424/70.12
5,830,536 A 11/1998 Garduno ..... 427/387
5,885,561 A * 3/1999 Flemming et al. ..... 424/62
5,902,411 A 5/1999 Williams et al. ..... 134/3
5,965,514 A 10/1999 Wierenga et al. ..... 510/433
6,043,208 A 3/2000 Durbut et al. ..... 510/238
6,090,766 A 7/2000 Brink ..... 510/240
6,110,882 A 8/2000 Evers ..... 510/240
6,165,285 A * 12/2000 Evers et al. ..... 134/40
6,165,965 A 12/2000 Schalitz et al. ..... 510/384
6,171,406 B1 1/2001 Otsuki ..... 134/7
6,177,394 B1 1/2001 Durbut et al. ..... 510/238
6,180,585 B1 1/2001 Schalitz et al. ..... 510/384
6,284,723 B1 * 9/2001 Zhou et al. ..... 510/384

* cited by examiner

*Primary Examiner*—Charles Boyer
(74) *Attorney, Agent, or Firm*—Renee J. Rymarz; Warren R. Bovee; Neil E. Hamilton

(57) ABSTRACT

The present invention is directed to a surface cleaning and maintenance composition including a non-ionic surfactant, a quaternary ammonium surfactant and water. Optionally, neutralizer and fragrance can be included in the composition. The inventive composition can be used in highly dilute concentration to clean and maintain stone surfaces while minimizing undesirable adverse appearance effects.

7 Claims, No Drawings

SURFACE MAINTENANCE COMPOSITION

CROSS-REFERENCE TO RELATED APPLICATIONS

NONE

STATEMENT REGARDING FEDERALLY SPONSORED RESEARCH OR DEVELOPMENT

NONE

BACKGROUND OF THE INVENTION

This invention relates generally to a composition for cleaning and maintaining a surface and in particular a stone surface. More particularly it relates to such a composition which provides for regular cleaning of some surfaces while maintaining a high gloss finish.

BACKGROUND OF THE ART

Marble is a natural stone that is relatively soft, therefore resulting in scratching and other surface damage which requires a high degree of maintenance. Additionally, marble and other stone surfaces are often reactive to components found in common cleaners and polishes. For these reasons considerable care must be taken in order to maintain a healthy looking surface. Other types of stone flooring including terrazzo, magnesite, limestone, granite and travertine also need to be maintained at a high level to reduce or remove scratches.

Organic acids such as oxalic acid have been used to clean and "recrystallize" stone type surfaces, in particular, floors. One drawback in using such a composition is the lengthy application time and subsequent cumbersome clean up. For example, typical applications of oxalic acid or oxalic acid based products requires about 15 to 30 minutes per 20 to 25 square feet. Such compositions are applied as powder or slurry along with copious amounts of water with buffing. The composition is not allowed to dry, as significant, undesirable streaking will occur. The subsequent clean up involves moving the product to the next section of the floor or mopping up the residue. Additionally, during application, the composition must continually be removed to determine the level of gloss achieved. Lack of control in the process as well as labor intensive, messy application and clean up, are significant problems encountered when using such composition. Additionally, after the desired gloss is achieved, the daily maintenance of such a high gloss surface is difficult to maintain. Often times streaking and "fish eyes" are a problem with commonly used cleaners. Further, over time, a dulling of the high gloss finish becomes a problem.

In summary, a considerable number of deficiencies exist in the art relating to stone surface maintenance composition and methods of application. While prior art cleaning compositions may adequately clean the surface, the use of common surface cleaners result in a dulled finish, streaking and fish eyes. Also, many compositions tend to etch the surface and cause considerable damage to the substrate. Thus, the more labor intensive and time consuming recrystallization and/or polishing exercise must be frequently repeated to maintain the desired appearance.

Thus, there is an ongoing search for maintenance compositions which can be spread easily, clean the surface while maintaining the desired high gloss without streaking dulling, fish eyes, etching or other damage to the stone surface. Clearly there is a need for improved and novel stone surface maintenance compositions that provide adequate cleaning while maintaining the high gloss finish of such surfaces. In particular, there is a need for improved maintenance compositions, which overcome the shortcomings of the prior art.

OBJECTS OF THE INVENTION

It is an object of this invention to provide a surface maintenance composition which overcomes some of the problems and shortcomings of the prior art. A further object of the invention is to provide a maintenance composition that can be used on stone surfaces in an efficient manner. Another object of this invention is to provide a maintenance composition for stone surfaces which maintains the high gloss while maintaining a level of cleaning capability for stone surfaces. Another object of the invention is to provide a daily maintenance cleaner for use on stone surfaces that reduces streaking and other undesirable adverse appearance effects. Still another object of the invention is to provide a daily maintenance composition for stone surfaces which does not dull or streak or etch or otherwise damage the surface. These and other important objects will be apparent from the following description.

SUMMARY OF THE INVENTION

The present invention is directed to a cleaning composition which includes a non-ionic surfactant, a quaternary ammonium surfactant and water. Additionally, a neutralizer can be included in the composition. The composition can optionally include fragrance or other appearance enhancing additives. Typical compositions include about 0.01 to 0.50 weight percent of a non-ionic surfactant, about 0.003 weight percent to about 0.50 weight percent quaternary ammonium surfactant and about 90 to 99.97 weight percent water. A neutralizer can be present in amounts ranging from about 0.0001 to about 0.0005 weight percent of the composition. Further, the composition can include about 0.0001 to about 0.01 weight percent or more of a fragrance.

The non-ionic surfactants of the inventive composition can include alkanolamides, amine oxides, block polymers, ethoxylated alcohols, ethoxylated alkyl phenols, ethoxylated fatty acids, ethoxylated fatty esters and oils, sorbitan derivatives, sucrose esters, glucose esters and derivatives thereof. Alternatively, blends of these non-ionic surfactants can be utilized. Preferably, the non-ionic surfactant is an ethoxylated alcohol.

The quaternary ammonium surfactants of the present invention are preferably quaternary ammonium chlorides such as di(octyl decyl)dimethyl ammonium chloride.

Typical neutralizers can include alkaline, alkali and alkaline earth salts such as sodium hydroxide, sodium bicarbonate, sodium carbonate, potassium hydroxide, potassium bicarbonate, potassium carbonate, magnesium hydroxide, magnesium carbonate, calcium hydroxide, calcium carbonate and other neutralizing materials that are well known to those skilled in the art. One preferred neutralizer is sodium hydroxide.

Preferred embodiments of the present invention include about 0.02–0.2 weight percent of a non-ionic surfactant, about 0.005–0.1 weight percent of quaternary ammonium surfactant and about 95–99.97 weight percent of water. The preferable amount of neutralizer in the inventive composition is 0.0001 to about 0.0005 or enough to achieve a pH of about 7.

Such compositions have been found to be useful in the maintenance of stone surfaces to maintain a high gloss finish without damage to the high gloss finish or the stone surface. The inventive compositions can be used daily as a maintainer and/or cleaner for the stone surfaces without damage or distortion of the high gloss finish.

DETAILED DESCRIPTION OF THE PREFERRED EMBODIMENTS

The present invention is directed to an improvement in compositions for treating stone surfaces—mainly, compositions for cleaning and maintenance of stone surfaces and methods of maintaining such stone surfaces. The cleaning compositions of the present invention include at least one non-ionic surfactant, at least one quaternary ammonium surfactant and water, as described in further detail below.

Non-ionic surfactants such as alkanolamides, amine oxides, block polymers, ethoxylated alcohols, ethoxylated alkyl phenols, ethoxylated fatty acids, ethoxylated fatty esters and oils, sorbitan derivatives, sucrose esters and derivatives and glucose esters and derivatives thereof, and blends thereof along with other types of non-ionic surfactants have been found to be particularly useful in the present invention. In particular, ethoxylated alcohols have been found to produce acceptable results when used in the present compositions. The inventive composition typically includes about 0.01 to about 0.50 weight percent of at least one non-ionic surfactant. Preferred embodiments include about 0.02 to 0.20 weight percent of a non-ionic surfactant. Highly preferred embodiments include about 0.030 to about 0.12 weight percent of a non-ionic surfactant.

The quaternary ammonium surfactants of the present invention work with the non-ionic surfactant to provide the enhanced results provided by the inventive composition. Quaternary ammonium surfactants such as quaternary ammonium chloride can be utilized in the inventive compositions. Preferably, one such quaternary ammonium chloride that has proven useful is di(octyl decyl)dimethyl ammonium chloride. Preferably, the inventive compositions include about 0.003 weight percent to about 0.5 weight percent quaternary ammonium surfactant.

Preferred embodiments include about 0.005 to 0.10 weight percent quaternary ammonium surfactant. Highly preferred embodiments include about 0.008 to 0.040 weight percent quaternary ammonium surfactant. Quaternary ammonium surfactants that have proven useful include BTC 2125, BTC 818, BTC 885 and BTC 1010, all available from Stepan Company. Additionally, another quaternary ammonium surfactant that has proven useful is Mackernium 621 available from the McIntyre Group.

The inventive compositions also include water. Preferably the compositions include about 90 to about 99.97 weight percent water. This enables the cleaning composition to be highly diluted and optimizes the benefit of the cleaner while reducing the cleaning capabilities while reducing the adverse effect often found with some cleaners. It has been found that the more dilute the cleaning composition, the better the cleaning and resulting effect are on a high gloss stone surface.

The inventive compositions also preferably include a neutralizer such as a 50 percent solution of sodium hydroxide. The neutralizer is used to neutralize the formula to a pH of about 7, neutral. This appears to be required due to the slightly acid nature of quaternary ammonium chlorides which otherwise would result in a slightly acidic formula which would cause damage to the stone surfaces and result in hazing and etching. The neutralizer is typically present in the range of about 0.0001 to about 0.0005 weight percent of the composition. Typically neutralizers should be present in sufficient amounts to achieve a pH of about 7.

The inventive composition can also include other additives such as fragrance if desirable. Typical fragrances are present in amount of about 0.0001 to about 0.01 weight percent of the total composition. One such fragrance is IFF 2832-HF which is an apple fragrance. Other fragrances are suitable for use and are known to one of ordinary skill in the art.

Example 1 represents a composition of the present invention.

Example 1

| Ingredients | Percent by Weight |
|---|---|
| Water | 99.84 |
| Tergitol 15-S-7 | 0.12 |
| BTC-818 | 0.0352 |
| IFF2832HS | 0.0031 |
| Sodium Hydroxide, 50% | 0 |

The composition of Example 1 is prepared by adding the ingredients in the order as listed and stirring until homogenous and then neutralizing with sodium hydroxide.

The composition of Example 2 is prepared by adding the ingredients in the order as listed and stirring until homogenous and then neutralizing with sodium hydroxide.

Example 2

| Ingredients | Percent by Weight |
|---|---|
| Water | 99.92 |
| Tergitol 15-S-7 | 0.061 |
| BTC-818 | 0.0176 |
| IFF2832HS | 0.0016 |
| Sodium Hydroxide, 50% | 0 |

The composition of Example 3 is prepared by adding the ingredients in the order as listed and stirring until homogenous and then neutralizing with sodium hydroxide.

Example 3

| Ingredients | Percent by Weight |
|---|---|
| Water | 99.96 |
| Tergitol 15-S-7 | 0.030 |
| BTC-818 | 0.009 |
| IFF2832HS | 0.0008 |
| Sodium Hydroxide, 50% | 0 |

These examples represent a few of the possible formulations of the inventive composition. While the principles of this invention have been described in connection with specific embodiments it should be understood clearly that these descriptions are made only by way of example and are not intended to limit the scope of the invention.

What is claimed is:

1. A composition for cleaning stone surfaces consisting of:

(a) about 0.01 to about 0.5 weight percent of a non-ionic surfactant;

(b) about 0.003 to about 0.5 weight percent of a quaternary ammonium surfactant;

(c) about 90 to about 99.97 weight percent water;

(d) a neutralizer in an amount sufficient to bring the pH of the composition to about 7;

(e) optionally a fragrance; and (f) optionally other appearance enhancing additives;

wherein the composition does not dull, streak, etch, distort, or damage a stone surface when applied thereto.

2. The composition of claim 1, wherein the neutralizer is present in an amount of from 0.0001 to about 0.0005 weight percent.

3. The composition of claim 1, wherein the non-ionic surfactant is selected from the group consisting of alkanolamides, amine oxides, block polymers, ethoxylated alcohols, ethoxylated alkyl phenols, ethoxylated fatty acids, ethoxylated fatty esters and oils, sorbitan derivatives, sucrose esters and derivatives, and glucose esters and derivative, and blends thereof.

4. The composition of claim 1, wherein the quaternary ammonium surfactant is a quaternary ammonium chloride.

5. The composition of claim 1, wherein the neutralizer is selected from the group consisting of sodium hydroxide, sodium bicarbonate, sodium carbonate, potassium hydroxide, potassium bicarbonate, potassium carbonate, magnesium hydroxide, magnesium carbonate, calcium hydroxide, and calcium carbonate.

6. The composition of claim 1, wherein the stone surface is a marble surface.

7. The composition of claim 1, wherein the composition comprises the fragrance in an amount of from about 0.0001 to about 0.01 weight percent.

* * * * *